United States Patent [19]

Nakahara

[11] Patent Number: 5,008,588

[45] Date of Patent: Apr. 16, 1991

[54] WEDGE-TYPE LAMP BULB ASSEMBLY

[75] Inventor: Toshiro Nakahara, Hiratsuka, Japan

[73] Assignee: Ichikoh Industries, Ltd., Tokyo, Japan

[21] Appl. No.: 369,233

[22] Filed: Jun. 22, 1989

[30] Foreign Application Priority Data

Jun. 22, 1988 [JP] Japan ..... 63-81675

[51] Int. Cl.[5] ..... H01K 1/46; H01R 17/00

[52] U.S. Cl. ..... 313/318; 439/619; 439/699; 439/375

[58] Field of Search ..... 313/318, 315; 439/611–619, 699, 375, 356

[56] References Cited

U.S. PATENT DOCUMENTS 4,883,434 11/1989 Toyoshima ..... 313/318 X

*Primary Examiner*—Kenneth Wieder

*Attorney, Agent, or Firm*—Foley & Lardner, Schwartz, Jeffery, Schwaab, Mack, Blumenthal & Evans

[57] ABSTRACT

A wedge-type lamp bulb assembly consists of a bulb containing a filament and a wedge-shaped base extending from the bulb. Several lead wires connected to the filament are led out from the bottom of the wedge-shaped base, and folded along the front and rear sides of the wedge-shaped base. There are provided inside the socket in which the wedge-shaped base is removably held a plurality of terminals which are in resilient contact with the lead wires, and a pair of guide protrusions is formed on the inner walls of the socket along the inserting direction of the wedge-type lamp bulb. There is formed on the front and rear sides of the wedge-shaped base in positions corresponding to the pair of guide protrusions a pair of protrusions defining guide ways through which the guide protrusions are passed. Thus, the wedge-type bulb can be easily assembled into the socket and also securely held therein.

3 Claims, 10 Drawing Sheets

WEDGE-TYPE LAMP BULB ASSEMBLY

BACKGROUND OF THE INVENTION

Field of the Invention

The present invention relates to a wedge-type lamp bulb assembly having a wedge-type lamp bulb and a socket which removably holds the wedge-type lamp bulb.

Description of the Prior Art

The wedge-type lamp bulb comprises a bulb portion containing a filament, and a wedge-shaped base; namely, it is of such a structure as to be held directly in a socket without using any conventional round base. FIGS. 1 to 3 show one example of conventional single-filament wedge-type lamp bulb assembly. As seen, the wedge-type lamp bulb 1 comprises a glass bulb 1*a* in which argon gas is charged and also a filament 1*c* is disposed, and a wedge-shaped base 1*b*. The filament 1*c* is supported by two lead wires 1*e* and 1*f* led out from the bottom of the wedge-shaped base 1*b*, bent at this base bottom, extended and folded back along the opposite lateral sides of the base 1*b*. The led-out portions of the above-mentioned lead wires 1*e* and 1*f* passed hermetically through the wedge-shaped base 1*b* are U-shaped as viewed from the front, which is seen from FIG. 1, and also L-shaped as viewed from the lateral sides, which is shown in FIG. 2. For flexing the lead wire portions near the above-mentioned folded-back portions of the lead wires, the wedge-shaped base 1*b* has recesses 1*i* and 1*j* formed therein in places corresponding to the folded-back portions of the lead wires. For assembling this wedge-type lamp bulb 1 into the socket 300 in a conventional lamp bulb assembly, contact terminals 2 like a leaf spring (will be referred to simply as "terminals") attached in the socket 300 are generally slid on and into contact with the above-mentioned contact terminals 1*e* and 1*f*. Namely, when the portions of the lead wires 1*e* and 1*f* near the above-mentioned U-shaped portions are flexed into these recesses 1*i* and 1*j*, respectively, as forced by the terminals 2, the lead wires 1*e* and 1*f* are electrically connected to the terminals 2, respectively, and the wedge-type lamp bulb 1 is thus held. However, since the wedge-type lamp bulb 1 is removably held by only the terminals 2 in the socket 300 in the conventional lamp bulb assembly, the lamp bulb 1 is likely to deflect in the direction of arrow in FIG. 2 so that the filament 1*c* in the lamp bulb 1 is difficult to be securely positioned. Also, as the lamp bulb 1 deflects, the terminals 2 holding the lamp bulb 2 is likely to be flexed, causing the electrical connection between the lead wires and terminals to be astatic.

SUMMARY OF THE INVENTION

The present invention has an object to provide a wedge-type lamp bulb assembly in which the wedge-type lamp bulb can be securely held in the socket.

The present invention has another object to provide a wedge-type lamp bulb assembly in which incorrect assembly of the edge-type lamp bulb into the socket can be prevented.

The above-mentioned objects of the present invention can be attained by providing a wedge-type lamp bulb assembly comprising, according to the present invention, at least a pair of protruded members so formed on any one of the inner walls of the socket or of the surfaces of the wedge-shaped base, along the inserting/removing direction of the wedge-shaped base and in places opposite to each other as to engage on any one of the wedge-shaped base surfaces or of the socket inner walls.

These and other objects and advantages of the present invention will be better understood from the ensuing description made, by way of example, of the preferred embodiments of the present invention with reference to the drawings.

BRIEF DESCRIPTION OF THE DRAWINGS

FIG. 2 is a schematic side elevation of the wedge-type lamp bulb assembly in FIG. 1, showing the wedge-type lamp bulb is held in the holder; and FIG. 3 is a bottom view of the wedge-type lamp bulb in FIG. 1;

FIGS. 4 to 11 show a first embodiment of the wedge-type lamp bulb assembly according to the present invention, of which FIG. 4 is an exploded perspective view of the wedge-type lamp bulb assembly;

FIG. 5 is a plan view of the socket;

FIG. 6 is a front view of the double-filament wedge-type lamp bulb assembly;

FIG. 7 is a schematic side elevation of the wedge-type lamp bulb assembly in FIG. 6, with the internal elements of the lamp bulb omitted;

FIG. 8 is a bottom view of the wedge-type lamp bulb assembly in FIG. 6;

FIG. 9 is a sectional view taken along the line IX—IX of FIG. 5;

FIG. 10 is a sectional view taken along the line X—X of FIG. 5; and

Fig. 11 is a sectional view taken along the line XI—XI of FIG. 5;

FIGS. 12 to 17 show a second embodiment of the wedge-type lamp bulb assembly according to the present invention, of which FIG. 12 is an exploded perspective view of the socket;

FIG. 13 is a plan view of the socket;

FIGS. 14 and 15 are plan and bottom views, respectively, of the single-filament wedge-type lamp bulb assembly;

FIG. 16 is a sectional view taken along the line XVI—XVI and;

FIG. 17 is a sectional view taken along the line XVII—XVII.

DETAILED DESCRIPTION OF THE PREFERRED EMBODIMENTS

Figure 1:
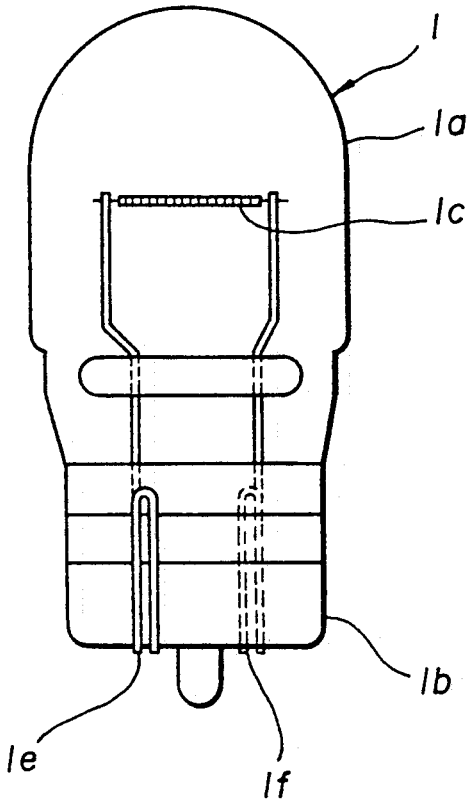
FIG. 1 (PRIOR ART)
FIGS. 1 to 3 show one example of the conventional single-filament wedge-type lamp bulb assembly, of which FIG. 1 the front view of the wedge-type lamp bulb assembly.
Figure 2:
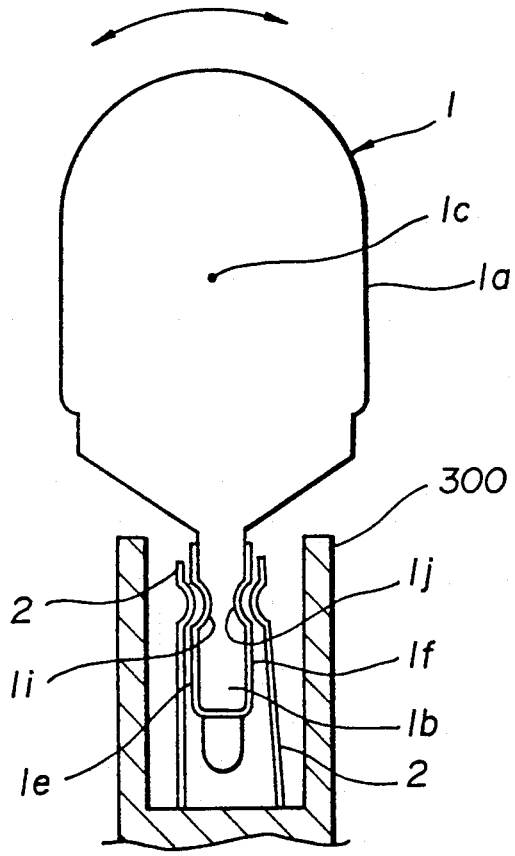
FIG. 2 (PRIOR ART)
Figure 3:
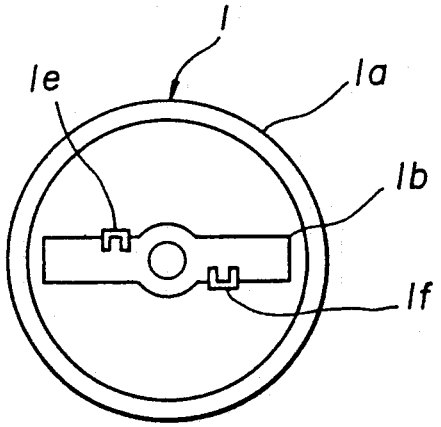
FIG. 3 (PRIOR ART)
Figure 4:
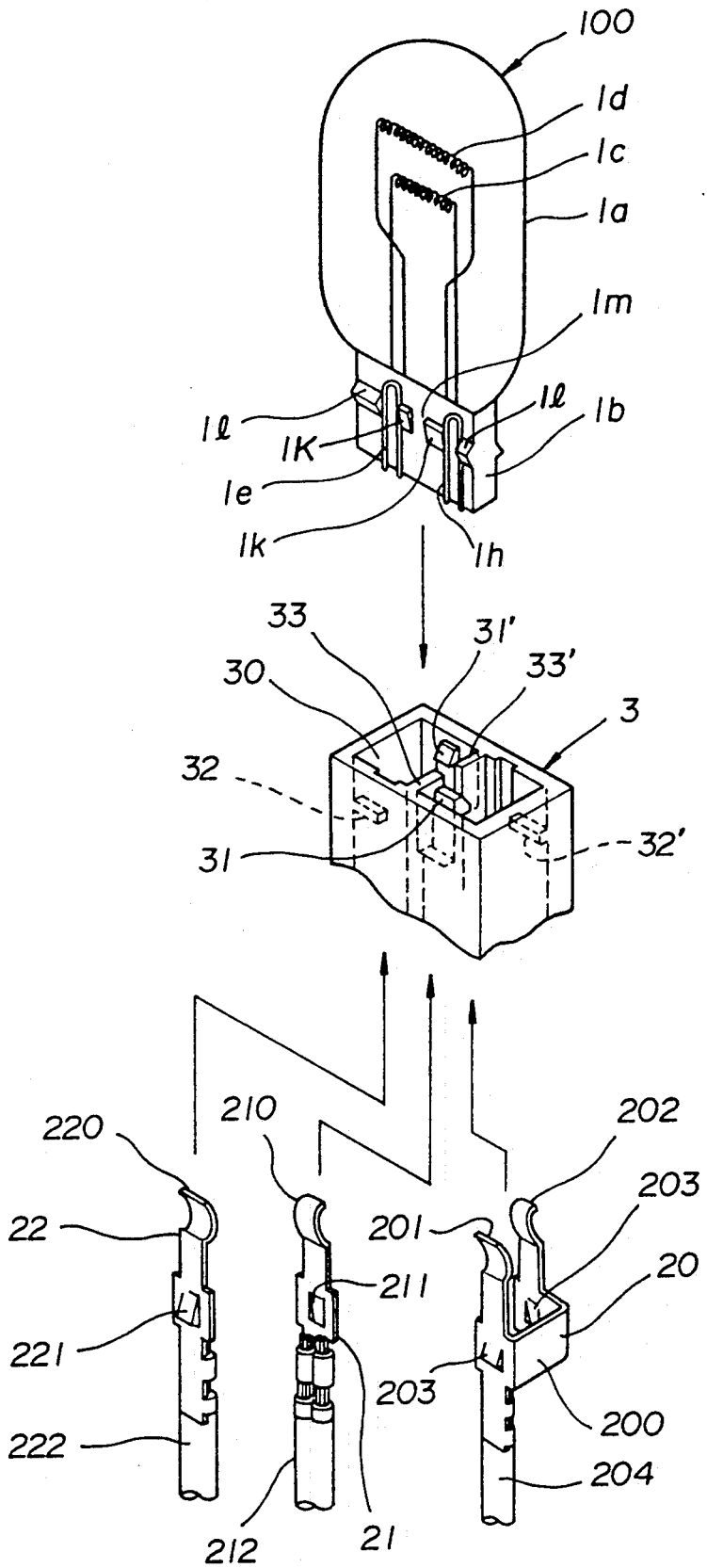
Figure 5:
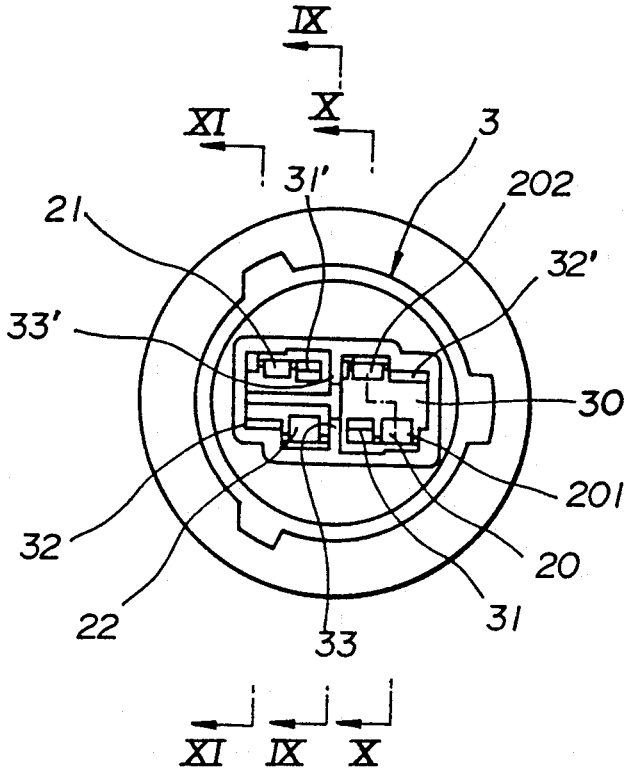
Figure 6:
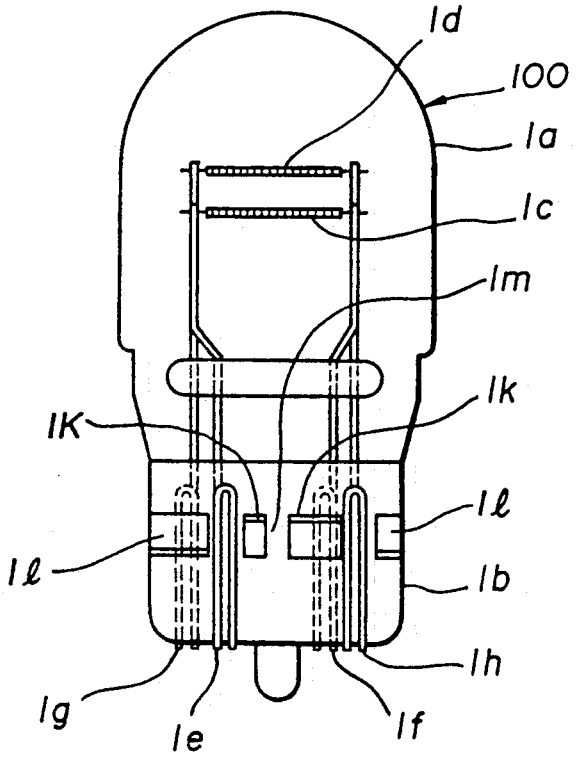
Figure 7:
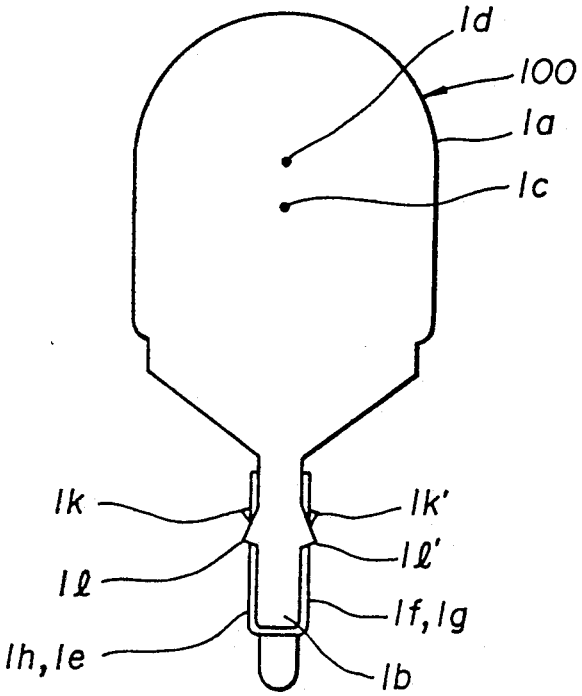
Figure 8:
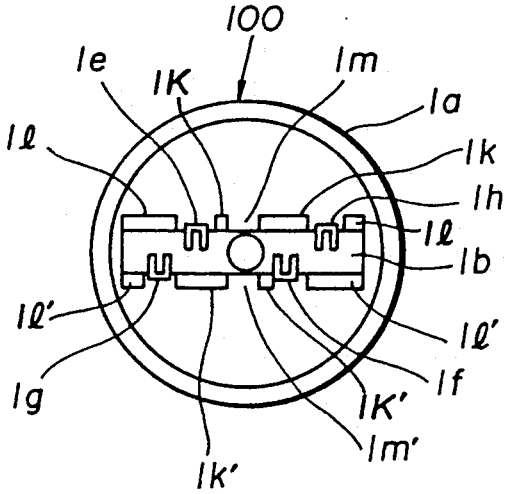
Figure 9:
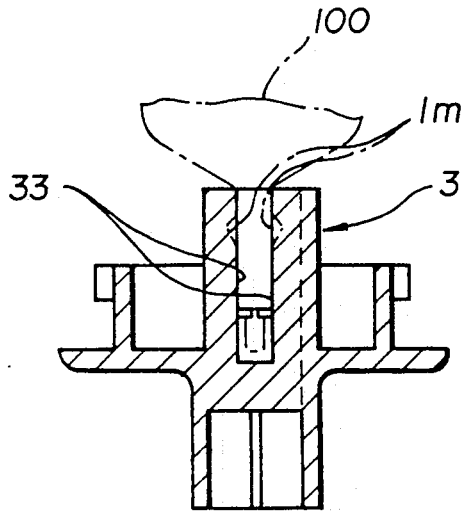

Referring now to FIGS. 4 to 11, the first embodiment of the wedge-type lamp bulb assembly according to the present invention will be described. In Figures, the same or similar elements as or to those in FIGS. 1 to 3 are indicated with the same or similar reference numerals as or to those in FIGS. 1 to 3. The double-filament wedge-type lamp bulb assembly 100 comprises a bulb portion 1*a* containing a main filament 1*c* and sub filament 1*d*, and a wedge-shaped base 1*b* through which lead wires 1*e*, 1*f*, 1*g* and 1*h* supporting the filaments 1*c* and 1*d* are hermetically passed. The two opposite surfaces, that is, the front and rear surfaces, of the wedge-shaped base 1b are formed as generally flat ones. The wedge-type lamp bulb 100 is to be inserted into a socket 3 from the direction of arrow in FIG. 4. The lead wires 1e and 1h are led out on the front surface of the wedge-shaped base 1b, while the lead wires 1f and 1g are led out on the rear surface. There is disposed nearly at the center of the front surface of the wedge-shaped base 1b a pair of protrusions 1k extending, as spaced a predetermined distance from each other, in a direction nearly perpendicular to the inserting direction of the wedge-type lamp bulb 100, that is, in the substantially horizontal direction, as shown in FIG. 6. Also, there is disposed at the right and left ends of the front surface of the wedge-shaped base 1b another pair of protrusions 11 generally in line with the protrusions 1k. As seen from FIGS. 6 and 11, protrusions of such kind are also disposed on the rear surface of the wedge-shaped base 1b. They are indicated with the reference numerals 1k' and 11', respectively. These protrusions are disposed nearly point-symmetrically with the protrusions 1k and 11 with respect to the center axis of the wedge-shaped base 1b.

Each of the protrusions 1k and 1k' has a generally triangular section being steep-sloped at upper side and gentle-sloped at the lower side while the protrusions 11 and 11' have each a generally triangular section being gentle-sloped at upper side and steep-sloped at lower side. One of the protrusions 1k and also one of the protrusions 1k' form a part of a locking means for preventing the wedge-type lamp bulb 100 from coming out of the socket 3, while one of the protrusions 11 and one of the protrusions 11' form a part of a means for defining a stroke end of the wedge-type lamp bulb 100 along the direction of insertion into the socket 3. Also, the other one of the protrusions 1k and the other one of the protrusions 1k' form together with the protrusions 11 and 11' forming a part of the means for defining the stroke end a channel through which the lead wires 1e and 1f are passed, respectively, while the other one of the protrusions 11 and the other one of the protrusions 11' form along with the protrusions 1k and 1k' forming a part of the locking means a channel through which the lead wires 1h and 1g are passed. Furthermore, a surface area 1m of the wedge-shaped base 1b between the protrusions 1k in pair and a surface area 1m' on the rear side of the wedge-shaped base 1b between the protrusions 1k' in pair are formed on the inner walls, respectively, of the socket 3 to form guide ways through which guide protrusions 33 and 33' for guiding the insertion of the wedge- type lamp bulb 100 are passed, as will be described later.

The socket 3 is made of a synthetic resin, and it has a space 30 in which the wedge-shaped base 1b of the wedge-type lamp bulb 100 is inserted and retained. The space 30 is defined by four inner walls of the socket 3 corresponding to the front and rear sides and two lateral sides of the wedge-shaped base 1b, and there are disposed on the opposite inner walls of the socket 3 corresponding to the surface areas 1m and 1m' of the wedge-shaped base 1b the above-mentioned pair of guide protrusions 33 and 33' as opposite to each other and spaced nearly a distance between the front and rear sides of the wedge-shaped base 1b. The end faces opposite to each other of the guide protrusions 33 and 33' are so constructed that when the wedge-shaped base 1b is inserted, it is guided by the pair of protrusions 1k and 1k', respectively, while being in contact with the surface area 1m on the front side and the surface area 1m' on the rear side.

Figure 10:
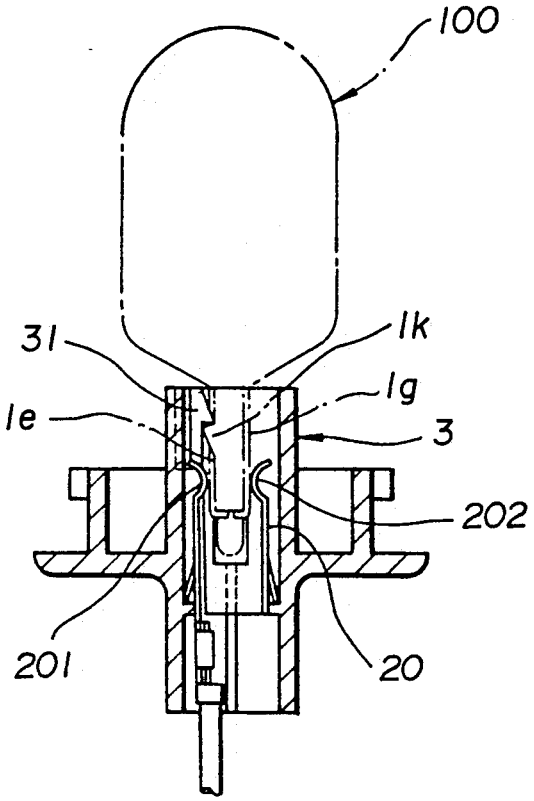
Figure 11:
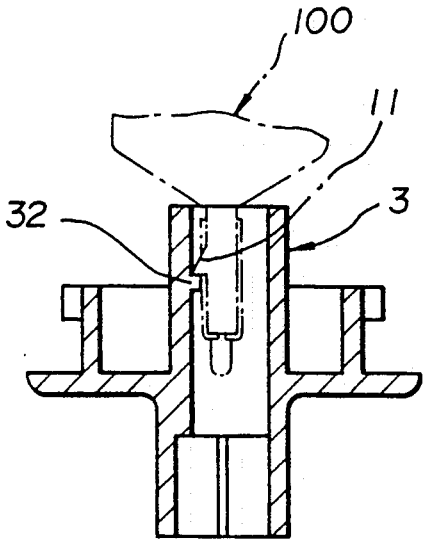
Figure 12:
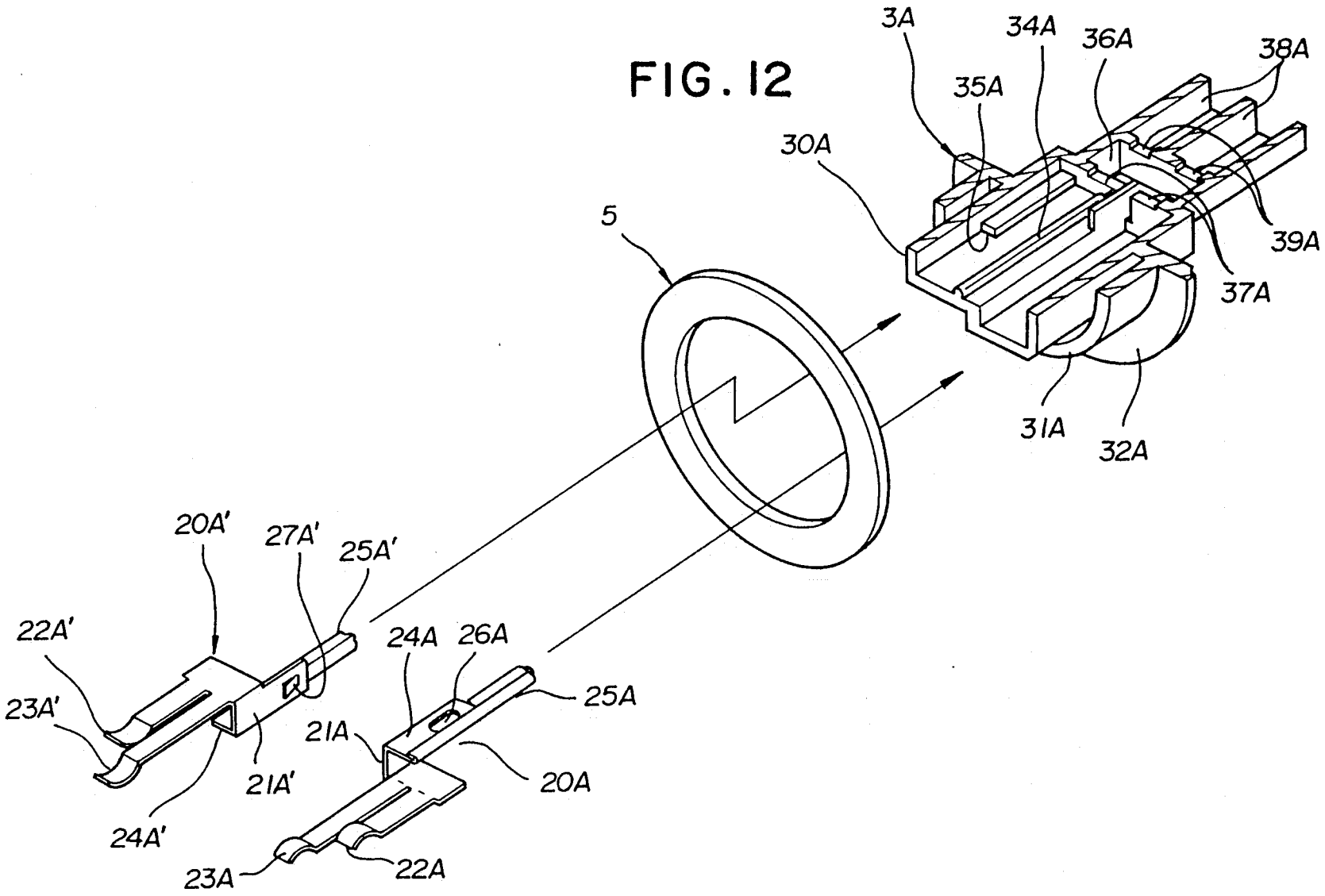

Further, correspondingly to the protrusions 1k and 1k' formed on the front and rear sides, respectively, of the wedge-shaped base 1b, there are formed on the inner walls opposite to each other of the socket 3 protrusions 31 and 31' which form locking means together with the protrusions 1k and 1k', respectively. The protrusions 31 and 31' are formed like a resilient pawl having a triangular section of which the upper side is steep-sloped and the lower side is gentle-sloped, as shown in FIGS. 4 and 5. As shown in FIG. 10, as the wedge-shaped base 1b of the wedge-type lamp bulb 100 is inserted into the socket 3, the protrusions 31 and 31' are opened out by the protrusions 1k and 1k' with which they are in contact, and thereafter the flat surfaces engage on the steep slopes of the protrusions 1k and 1k', so that the wedge-type lamp bulb 100 will not come out of the socket 3. Similarly, correspondingly to the protrusions 11 and 11', there are formed on the inner walls opposite to each other of the socket 3 protrusions 32 and 32' extended from the inner walls of the socket 3 and nearly perpendicularly to these inner walls and which form together with the protrusions 11 and 11', respectively, means for defining a stroke end. As shown in FIG. 11, the lower ends of the protrusions 11 and 11' are blocked by the protrusions 32 and 32', respectively, against moving in the inserting direction.

The reference numerals 20, 21 and 22 indicate a first, second and third terminals, respectively, made of an electrically conductive material. The first terminal 20 has a terminal base 200 of which the section is generally C-shaped, and a pair of resilient contacts 201 and 202 extending vertically from the terminal base 200 and of which the end is rounded. Retaining pieces 203 are formed as partially cut and lifted at the lateral sides of the terminal base 200 from which the pair of resilient contacts 201 and 202 extend vertically, and a wire 204 is connected as calked to the lower end at one side of the terminal base 200. The second and third terminals 21 and 22 have resilient contacts 210 and 220, respectively, of which the free end is rounded, and also have retaining pieces 211 and 221, respectively, formed as partially cut and lifted at the respective centers. These terminals have wires 212 and 222, respectively, connected as calked to the respective lower ends thereof. The terminals 20, 21 and 23 are so assembled into the socket that when the wedge-shaped base 1b is inserted into the socket 3, the rounded ends of the resilient contacts 201 and 202 of the first terminal 20 are in contact with the lead wires 1h and 1f, respectively, while the rounded ends of the resilient contacts 210 and 220 of the second and third terminals 21 and 22, respectively, are in contact with the lead wires 1e and 1g, respectively.

According to this embodiment, when the wedge-type lamp bulb 100 is mounted into the socket 3, the pair of protrusions 1k of the wedge-shaped base 1b is guided by the guide protrusion 33 of the socket 3 in the inserting direction, while the pair of protrusions 1k' of the wedge-shaped base 1b is guided by the guide protrusion 33' of the socket. Namely, with the surface areas 1m and 1m' being in contact with the guide protrusions 33 and 33', respectively, the wedge-shaped base 1b is introduced into the socket 3 until the protrusions 11 and 11' abut the protrusions 32 and 32', respectively, of the socket 3. At this time, the resilient contacts 201, 202, 210 and 220 of the terminals 20, 21 and 23, respectively, are in resilient contact with the lead wires 1h, 1f, 1g and 1e, respectively, of the wedge-type lamp bulb 100, so that the wedge-type lamp bulb 100 is mechanically held in the socket 3 and also electrically connected to the latter. Since the wedge-type lamp bulb 100 is held in the socket 3 with the guide protrusion 33 of the socket 3 being engaged at both sides thereof on the pair of protrusions 1*k* formed on the front side of the wedge-shaped base 1*b* while the guide protrusion 33' of the socket 3 is being engaged at both sides thereof on the pair of protrusions 1*k'* formed on the rear side of the wedge-shaped base 1*b*, it is very securely held as compared with the conventional wedge-type lamp bulb which is held by the terminals. Therefore, the filaments 1*c* and 1*d* of the wedge-type lamp bulb 100 can be accurately positioned. The mounting of the wedge-type lamp bulb 100 into the socket 3 has just been described in the above. Also the wedge-type lamp bulb 100 can be inserted and removed simply and securely into/from the socket 3 since the guide protrusions 33 and 33' of the socket 3 form together with the two pairs of protrusions 1*k* and 1*k'* of the wedge-shaped base 1 a guide means for the wedge-type lamp bulb 100. Also according to this embodiment, since the lower surfaces of the protrusions 11 and 11' of the wedge-type lamp bulb 100 abut the upper surfaces, respectively, of the protrusions 32 and 32' formed in the socket 3, the stroke end of the the wedge-type lamp bulb 100 in the inserting direction can be defined. Therefore, the wedge-type lamp bulb 100 can be simply set into the socket 3 and the positions of the filaments 1*c* and 1*d* of the wedge-type lamp bulb 100 can be maintained more accurately. Also, when the protrusions 11 and 11' abut the protrusions 32 and 32', respectively, a clicking can be felt, from which it is known by feeling that the wedge-type lamp bulb 100 is securely set in the socket 3. Furthermore, according to this embodiment, since the lower surfaces of the protrusions 31 and 31' of the socket 3 engage the upper surfaces of the protrusions 1*k* and 1*k'* of the wedge-type lamp bulb 100 to lock the latter, it is possible to prevent the wedge-type lamp bulb 100 from coming out. Moreover, the resilient engagement between these protrusions 1*k* and 1*k'* and the protrusions 31 and 31' permits to eliminate the backlash of the wedge-type lamp bulb 100 in the removing direction and a clicking can be felt at the time of that resilient engagement. It is known by feeling that the wedge-type lamp bulb 100 is securely set in the socket 3. Also according to this embodiment, since the surface of the wedge-shaped base 1*b* at which the lead wires are led out is formed generally flat, while the resilient contacts of the terminals which are in contact with the lead wires 1*e*, 1*f*, 1*g* and 1*h* are rounded, the resilient contacts are in point contact with the lead wires so that the contact pressure is large, which provides a good electrical connection between them.

The lead wires 1*e*, 1*f*, 1*g* and 1*h* and the terminals 20, 21 and 22 of the socket 3 are laid symmetrically to one another around the center axis of the socket 3, which is an advantage that the wedge-type lamp bulb 100 can be mounted as inserted into the socket 3 without being anxious about the inserting direction.

FIGS. 12 to 17 show a second embodiment of the wedge-type lamp bulb assembly according to the present invention. In Figures, the reference numeral 3A indicates a socket made of a synthetic resin by molding. The socket 3A has formed at one end thereof a hollow, rectangular tube-like bulb retention chamber 30A open at the front end thereof. There are formed around and integrally with the bulb retention chamber 30A a cylindrical portion 31A and flange 32A. Three engagement pawls 33A are provided integrally the open edge of the cylindrical portion 31A and as spaced from the flange 32A. There is provided on the inner circumferential surface of the bulb retention chamber 30A a pair of guide protrusions 34A and 34A' in point-symmetry with each other with respect to the axial direction (removing direction of the wedge-type lamp bulb lA) of the bulb retention chamber 30A, and also there are provided on the inner circumferential surface of the bulb retention chamber 30A a pair of stopper steps 35A and 35A' in point-symmetry with each other with respect to the axial direction. A sealant-charged chamber 36A which is open at the lateral side thereof is provided at the middle portion of the socket 3A. There is formed in the septum (bottom wall at the closed end of the bulb retention chamber 30A) between the sealant-charged chamber 36A and bulb retention chamber 30A lead-in holes 37A for fixing the terminal. Also there are formed at the other end of the socket 3A a connector chamber 38A open at the rear end thereof. Further there are formed lead-in holes 39A in the septum between the connector chamber 38A and sealant-charged chamber 36A. The reference numerals 20A and 20A' indicate terminals, respectively, in pair. The terminals 20A and 20A' have terminals bases 21A and 21A', respectively, of which the section is C-shaped, resilient contacts 22A and 22A', respectively, extended from the respective terminal bases 21A and 21A' and of which the ends are rounded, and resilient engagement portions 23A and 23A', respectively. The terminals bases 21A and 21A' have formed thereon sealing portions 24A and 24A', respectively, and connectors 25 and 25A', respectively. There are formed in these sealing portions 24A and 24A' elongated holes 26A and 26A', respectively, and pawls 27A and 27A', respectively, formed as partially cut and lifted. The pair of terminals 20A and 20A' are fixed in the socket 3A with the round convex sides of the resilient contacts 22A and 22A' and resilient engagement portions 23A and 23A' being opposite to each other. Namely, the connectors 25A and 25A' and sealing portions 24A and 24A' of the two terminals 20A and 20A' are introduced, by inserting, into the lead-in holes 39A and 37A of the socket 3A and positioned in the connector chamber 38A and sealant-charged chamber 36A of the socket 3A, and the resilient contacts 22A and 22A' and resilient engagement portions 23A and 23A' of the two terminals 20A and 20A', respectively, are positioned in the bulb retention chamber 30A of the socket 3A. The sealant-charged chamber 30A of the socket 3A is charged with a sealant 4. Since the elongated holes 26A and 26A' are formed in the sealing portions, respectively, of the terminals, the sealant 4 passes through the elongated holes 26A and 26A' and reaches sufficiently the rear side of the sealing portions of the terminals. The sealant 4 goes to all corners in the sealant-charged chamber 36A of the socket 3A, thus providing a sufficient sealing.

Figure 13:
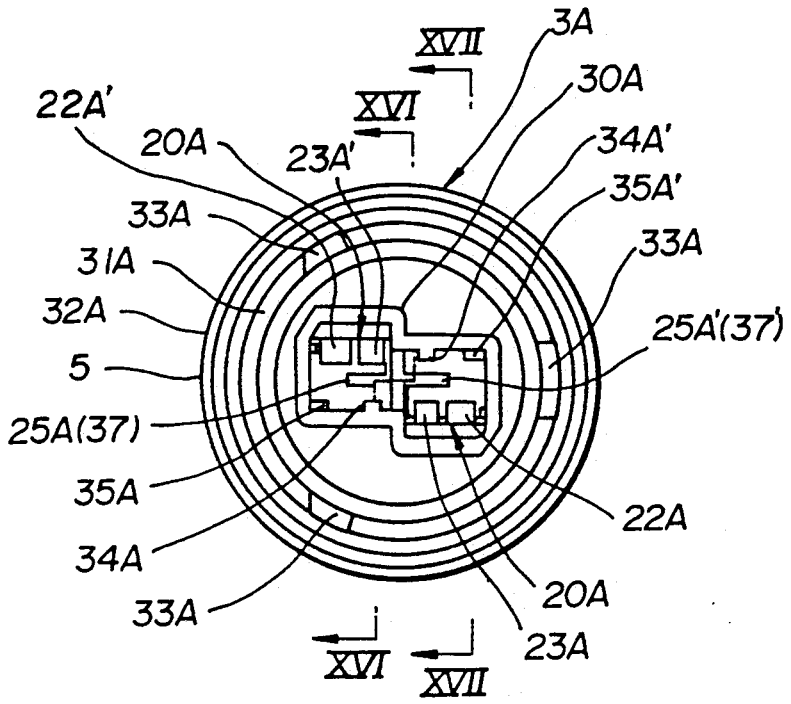
Figure 14:
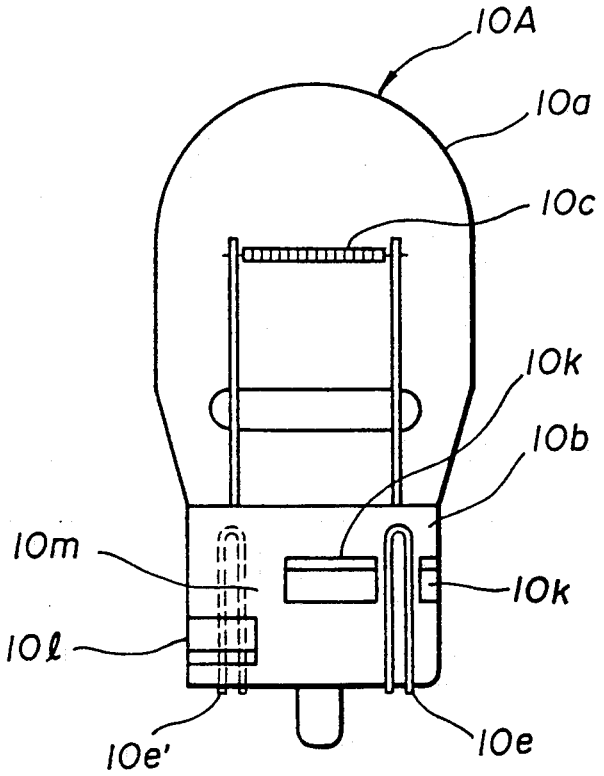
Figure 15:
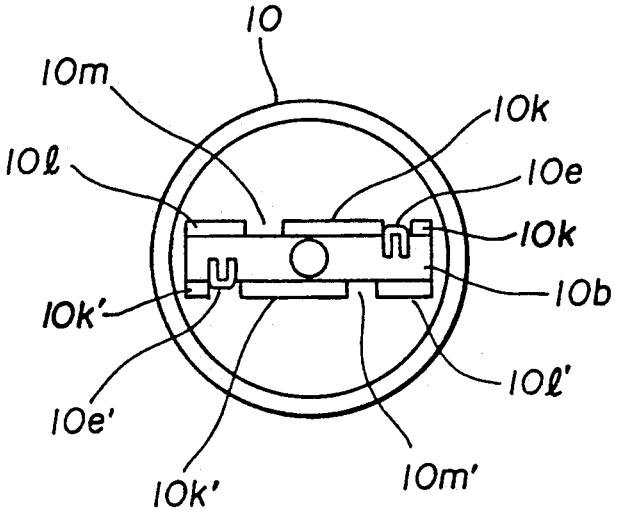
Figure 16:
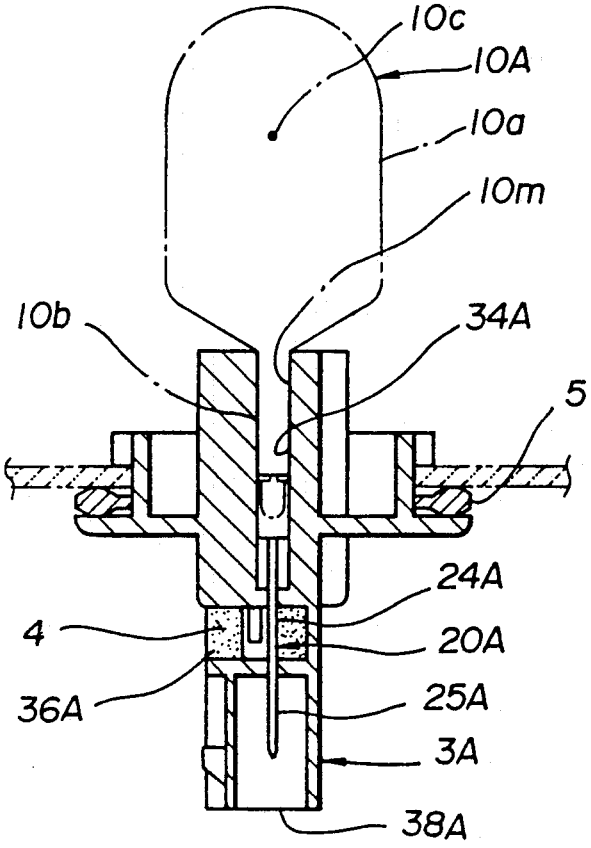
Figure 17:
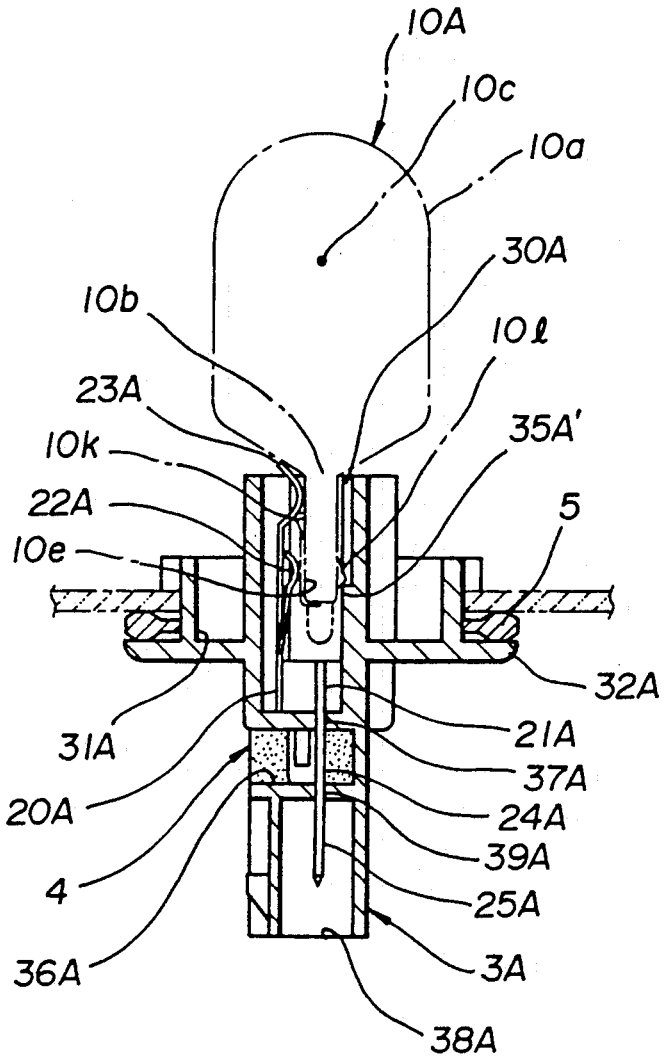

The reference numeral 10A indicates a single-filament wedge-type lamp bulb assembly comprising a glass bulb 10*a* in which a filament 10*c* is hermetically enclosed. The base portion of the glass bulb 10*a* is flattened to form a wedge-shaped base 10*b*. As shown in FIG. 15, there are formed protrusions 10*k* an 101 on the front side of the wedge-shaped base 10*b* and protrusions 10*k'* and 10*l'* on the rear side of the wedge-shaped base 10*b*, these protrusions being formed integrally in respective positions point-symmetrical with respect to the center axis. The surface area between the protrusions 10*k* and that between the protrusions 10*k'* form channels, respectively, through which the lead wires 10*e* and 10*e'* are passed. The surface area 10*m* defined by the protrusions 10*k* and 101 and the surface area defined by the protrusions 10*k'* and 101' are provided in the inserting/removing direction of the wedge-type lamp bulb 10A. As shown in FIG. 13, they are formed on the inner walls of the socket 3A to form guide ways, respectively, through which the guide protrusions 34A and 34A' for guiding the insertion of the wedge-type lamp bulb 10A are passed.

When the wedge-shaped base 10*b* of the wedge-type lamp bulb 10A is mounted into the bulb retention chamber 30A of the socket 3A, the pair of protrusions 10*k* and 101 of the wedge-shaped base 10*b* is guided by the guide protrusion 34A of the socket 3A in the inserting direction while the pair of protrusions 10*k'* and 101' is guided by the guide protrusion 34A' of the socket 3A in the inserting direction. The protrusions 101 and 101' of the wedge-type lamp bulb 10A are inserted until they abut the stopper steps 35A and 35A', respectively, of the socket 3A. Then, the resilient contacts 22A and 22A' of the terminals 20A and 20A' are in resilient contact with the lead wires 10*e* and 10*e'*, respectively, of the wedge-type lamp bulb 10A and the resilient engagement portions 23A and 23A' of the terminals 20A and 20A' are engaged at the lower surfaces thereof on the upper surfaces of the protrusions 10*k* and 10*k'* of the wedge-type lamp bulb 10A, so that the wedge-type lamp bulb 10A is removably held mechanically in the socket 3A and electrically connected to the socket. The reference numeral 5 indicates a packing.

The previously-described first embodiment concerns a double-filament wedge-type lamp bulb assembly, in which the guide protrusions 33 and 33' as means for guiding the insertion of the wedge-type lamp bulb into the socket are disposed nearly at the center of the socket and there are formed on the front and rear sides of the wedge-shaped base guide ways 1*m* and 1*m'* corresponding to the guide protrusions 33 and 33'. The second embodiment relates to a single-filament wedge-type lamp bulb assembly, in which as means for guiding the insertion of the wedge-type lamp bulb into the socket, the guide protrusions 34A and 34A' are disposed off the center of the socket, and there are formed on the front and rear surfaces of the wedge-shaped base guide ways 10*m* and 10*m''* corresponding to the guide protrusions 34A and 34A'. Since the positions of the means for guiding the insertion of the wedge-type lamp bulb into the socket are shifted, when the wedge-type lamp bulb is installed into the socket, it can be prevented to assemble, by mistake, the double-filament wedge-type lamp bulb 100 into the socket 3A for the single-filament wedge-type lamp bulb 10A, or the single-filament wedge-type lamp bulb 10A into the socket 3 for the double-filament wedge-type lamp bulb 100.

In the aforementioned embodiments, the pair of guide protrusions is provided in the socket and guide ways through which the guide protrusions are to be passed are provided on the wedge-shaped base of the wedge-type lamp bulb. However, the pair of guide protrusions may be provided on the wedge-shaped base of the wedge-type lamp bulb and the guide ways through which the guide protrusions are to be passed may be provided in the socket.

As having been described in the foregoing, the wedge-type lamp bulb assembly according to the present invention comprises a socket and wedge-type lamp bulb, on which the pair of guide protrusions and a plurality of protrusions defining the guide ways through which the guide protrusions are passed are provided, respectively; therefore, the guide protrusions and guide ways permit an easy assembling of the wedge-type lamp bulb into the socket. Also, since the plurality of protrusions defining the guide ways through which the pair of guide protrusions is passed is held as engaged on the pair of guide protrusions, the wedge-type lamp bulb can be securely held in the socket. Hence, the filament of the wedge-type lamp bulb can be accurately positioned. Since the wedge-type lamp bulb can be securely held owing to the engagement between the pair of guide protrusions and the plurality of protrusions, it is not necessary to impart a bulb holding function to the plural terminals and so the electrical connection between the lead wires and terminals is highly stable.

What is claimed is:

1. A wedge-type lamp bulb assembly having a wedge-type lamp bulb consisting of a bulb containing a filament and a wedge-shaped base extending from the bulb, a plurality of lead wires connected to the filament being led out of a part of the wedge-shaped base and folded along the surfaces of the wedge-shaped base, and a socket which removably holds the wedge-shaped base, wherein there is mounted inside said socket a plurality of terminals which are in resilient contact with said lead wires, respectively, and there is formed on either the inner wall of said socket or the surfaces of said base and in positions opposite to each other along the inserting-/removing direction of said base at least a pair of protruding members which engages either the surfaces of said base or the inner wall of said socket.

2. A wedge-type lamp bulb assembly according to claim 1, said protruding members being so formed on the inner walls of said socket as to engage two surfaces opposite to each other of said base.

3. A wedge-type lamp bulb assembly according to claim 2, in which there are disposed on the two opposite surfaces of said base guide members for guiding the movement of said base in said inserting/removing direction while said pair of protruding members are being engaged on said surfaces.

* * * * *